US005718492A

United States Patent [19]

Ellison

[11] Patent Number: 5,718,492

[45] Date of Patent: Feb. 17, 1998

[54] CONNECTION STRUCTURE FOR COURTESY PANEL ON FURNITURE

[75] Inventor: Samuel J. Ellison, Wyoming, Mich.

[73] Assignee: Steelcase Inc., Grand Rapids, Mich.

[21] Appl. No.: 650,463

[22] Filed: May 20, 1996

[51] Int. Cl.[6] ..... A47B 17/06

[52] U.S. Cl. ..... 312/195; 312/263; 312/265.5; 408/231; 408/408.1

[58] Field of Search ..... 312/195, 194, 312/263, 265.5, 265.6; 403/408.1, 407.1, 405.1, 231; 108/143, 180

[56] References Cited

U.S. PATENT DOCUMENTS

| | | | |
|---|---|---|---|
| 2,853,351 | 9/1958 | Bassett . | |
| 2,928,703 | 3/1960 | Paulsen . | |
| 3,000,682 | 9/1961 | Loew et al. . | |
| 3,113,358 | 12/1963 | Zell et al. | 312/263 |
| 3,125,387 | 3/1964 | Abrahamson . | |
| 3,877,764 | 4/1975 | Hillier, Jr. | 403/408.1 X |
| 4,497,093 | 2/1985 | Haberkorn | 312/195 X |
| 5,076,723 | 12/1991 | Berger | 312/263 X |
| 5,130,494 | 7/1992 | Simonton et al. . | |
| 5,215,361 | 6/1993 | Brock, Jr. et al. | 312/195 |
| 5,291,643 | 3/1994 | Boeglin | 312/195 X |

FOREIGN PATENT DOCUMENTS

| | | | |
|---|---|---|---|
| 510346 | 10/1992 | European Pat. Off. | 312/265.5 |
| 572025 | 12/1993 | European Pat. Off. | 312/195 |
| 2446402 | 9/1980 | France | 403/408.1 |
| 406280832 | 10/1994 | Japan | 403/405.1 |
| 1321617 | 6/1973 | United Kingdom | 312/195 |

OTHER PUBLICATIONS

Exhibit A discloses a Steelcase 6000 Series desk offered for sale more than one year ago having a pivoting courtesy panel with screw attached upper flange.

*Primary Examiner*—Peter R. Brown
*Assistant Examiner*—Hanh V. Tran
*Attorney, Agent, or Firm*—Price, Heneveld, Cooper, DeWitt & Litton

[57] ABSTRACT

A desk includes a worksurface supported by supports defining a knee space under the worksurface and an access opening to the knee space under an edge of the worksurface. A courtesy panel is removably mounted to the furniture structure for movement between a closed position for covering the knee space for privacy and an open position to facilitate access to the knee space by repairment. A first bracket is attached under the worksurface above the courtesy panel, and a second bracket is slidably attached to a top of the courtesy panel for engaging the first bracket. The two brackets include mating apertures, and a thumb screw comprising polymeric material extended downwardly through the second bracket mateably into the first bracket to retain the assembly together.

15 Claims, 3 Drawing Sheets

CONNECTION STRUCTURE FOR COURTESY PANEL ON FURNITURE

BACKGROUND OF THE INVENTION

The present invention relates to connection structure for securing a courtesy panel, and more particularly relates to securing a removable courtesy panel in a closed position on a desk or similar furniture.

Courtesy panels are often positioned under worksurfaces to close off the knee space area under the worksurface. In some desks, the courtesy panel is removably secured under the worksurface so that the courtesy panel can be positioned out of the way to provide room under the worksurface for a repairman to maneuver, such as when installing or repairing electrical/telecommunication hardware. Typically, screws or fasteners are used to secure the courtesy panels in a closed position. However, courtesy panels made of wood have edges that are easily chipped or damaged. Sheet metal constructions are less susceptible to chipping and damage, but may not be preferred by all customers. Also, both wood and metal constructions may become stripped or damaged, thus making the screw/fastener loose and ineffective. Further, known constructions requiring apertures take at least one additional assembly operation to form and inevitably result in alignment problems. Thus, they necessarily require significant manufacturing and assembly time. Another problem is that screws/fasteners may be lost since they are relatively small "extra" parts.

At least one furniture manufacture utilizes a latching arrangement to secure a pivoting courtesy panel in a closed position. However, latching arrangements have the same problems of wear and damage as screw/fastener constructions, and further latches may not securely engage when the courtesy panel is moved to the closed position. Still another problem is that it is sometimes desirable to reverse the courtesy panel to hide a defect, but this cannot be done if the courtesy panel has holes therein for receiving attachment screws or for supporting a latch member.

Thus, a connecting arrangement for solving the aforementioned problems is desired.

SUMMARY OF THE INVENTION

The present invention includes a furniture article having a worksurface and a worksurface support defining a knee space under the worksurface. A courtesy panel is removably mounted to the worksurface support for movement between a closed position for covering an access opening to the knee space and an open position to facilitate access to the knee space. A connection arrangement includes a bracket configured to mateably engage an edge of the courtesy panel, and a fastener configured to releasably engage an apertured flange of the bracket to retain the courtesy panel in the closed position.

In a preferred form, the courtesy-engaging bracket slidably engages the courtesy panel so that it can be slid to a desired aligned position for use. Also, a mating second bracket is attached under the worksurface. The second bracket includes a leg, and the courtesy-engaging bracket includes a guide for receiving the leg. Apertures in the leg and the guide align for receiving a fastener to hold the courtesy panel in the closed position. Optimally, the fastener extends downwardly into the apertures so that, even if the fasteners becomes stripped, the connection will still securely hold. Advantageously, the connection structure requires very little manual labor, is low cost, and can be readily connected/disconnected at the point of use.

These and other features and advantages of the present invention will be further understood and appreciated by those skilled in the art by reference to the following specification, claims, and appended drawings.

DETAILED DESCRIPTION OF PREFERRED EMBODIMENT

Figure 1:
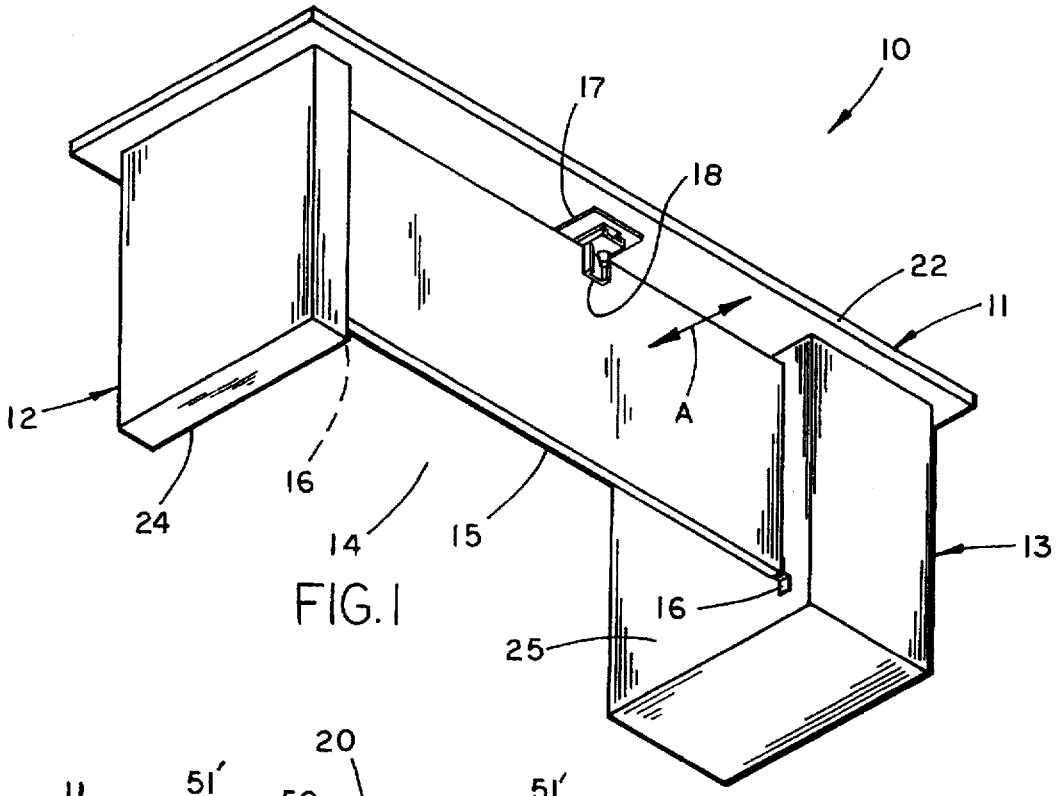
FIG. 1 discloses a bottom perspective view of the furniture article including the pivotable courtesy panel and the connection arrangement.
Figure 2:
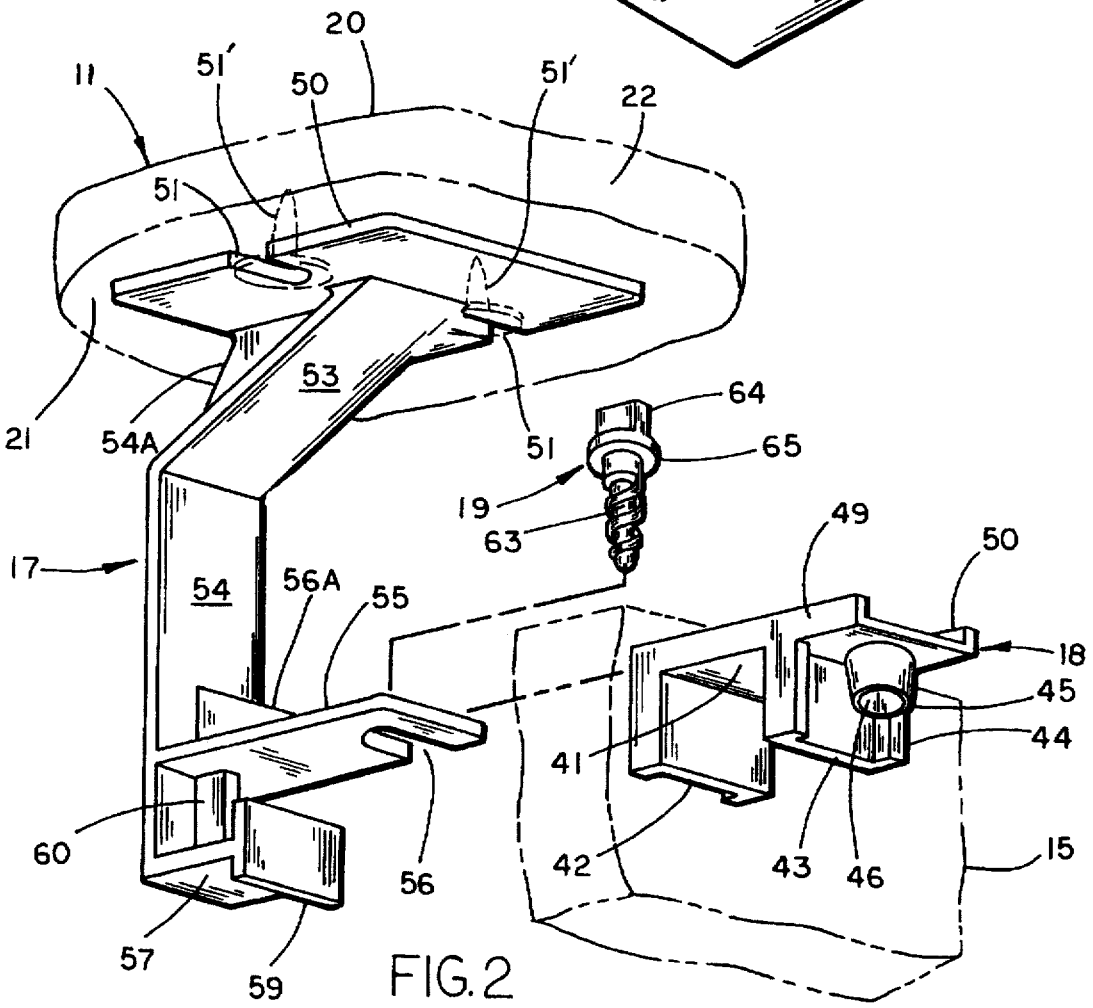
FIG. 2 includes an exploded perspective view of the connection arrangement.

For purposes of description herein, the terms "upper", "lower", "right", "left", "rear", "front", "vertical", "horizontal", and derivatives thereof shall related to the invention as oriented with the front of the desk being adjacent a person seated at the desk (see FIG. 1). However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The furniture article 10 (FIG. 1) in the form of a desk includes a worksurface 11 supported by floor engaging worksurfaces supports 12 and 13 at each end. A knee space 14 is defined under worksurface 11 between supports 12 and 13. A wood courtesy panel 15 is pivoted to supports 12 and 13 by opposing support brackets 16 located at each lower corner of panel 15 for removably supporting the courtesy panel 15. The courtesy panel 15 is movable between a vertical closed position covering an access opening to the knee space 14 from a rear of the desk (FIG. 1), and an open or removed position (not specifically shown). Upper and lower brackets 17 and 18 on the worksurface 11 and courtesy panel 15, respectively, matingly engage and receive a fastener such as threaded screw 19 that holds the courtesy panel 15 in the closed position. The brackets 17 and 18 are configured to securely hold the courtesy panel 15, but also to allow quick release of the courtesy panel 15 without use of tools. Still further, the courtesy-panel-engaging bracket 18 slidably engages an upper edge of the courtesy panel 15 in a manner that minimizes damage to the courtesy panel 15, thus allowing the courtesy panel 15 to be reversed in the field to hide damage or marks on the visible surface of the courtesy panel 15. Also advantageously, the brackets 17 and 18 are easily reversed to permit the courtesy panel to be removed from either the forward or rearward direction.

Worksurface 11 includes top and bottom surfaces 20 and 21, respectively, and a rear edge 22. Upper bracket 17 is attached to bottom surface 21 proximate rear edge 22, as discussed below. The worksurface 11 can include a slot or opening (not shown) along rear edge 22 for receiving a wire management component (FIG. 1) in the form of a trough-like compartment or the like. It is noted that the connection arrangement of brackets 17 and 18 are constructed with an offset to allow the connection structure to be used on many different style worksurfaces.

The illustrated worksurface supports 12 and 13 are an end panel and a drawer-receiving pedestal, respectively, that support worksurface 11 above a floor surface. The inwardly facing surfaces 24 and 25 of supports 12 and 13 define the bounds of the knee space 14. Knee space 14 is relatively confined, and it is desirable to provide easy access to knee space from either the front or the rear of the desk. For example, utility components, communication hardware, junction and switching boxes, and wiring management components/housings are often located under the worksurface 11 near rear edge 22. Further, desk 10 is often located against a wall, and it is desirable to not have to move the desk away from the wall in order to work on the components under the worksurface 11.

A variety of different support brackets 16 can be used to support courtesy panel 15 on furniture article 10, such as support brackets on supports 12 and 13 that permit a lower edge of the courtesy panel to be dropped into engagement with the support bracket and then permit the courtesy panel to be rotated into the closed position. In one known construction, the courtesy panel includes protruding rod sections that engage upwardly open U-shaped support brackets screwed to the inside surfaces or bottom of the support 12 and 13. Since several support brackets and arrangements are known in the art, each of which work satisfactorily, these arrangements and brackets need not be disclosed in detail in this application for an understanding of the present invention. With courtesy panel 15 mounted on support brackets 16, at least the upper edge of courtesy panel 15 is pivotally or movably supported on desk 10 below worksurface 11 for movement along path "A".

Figure 5:
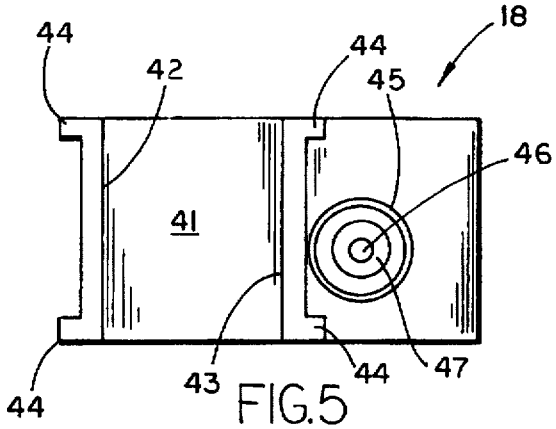
FIGS. 3–5 are orthogonal views of the courtesy panel engaging bracket.
Figure 4:
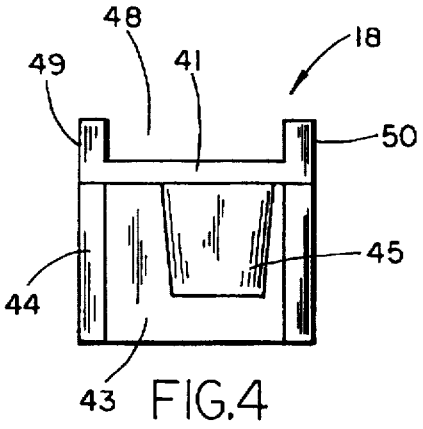
Figure 3:
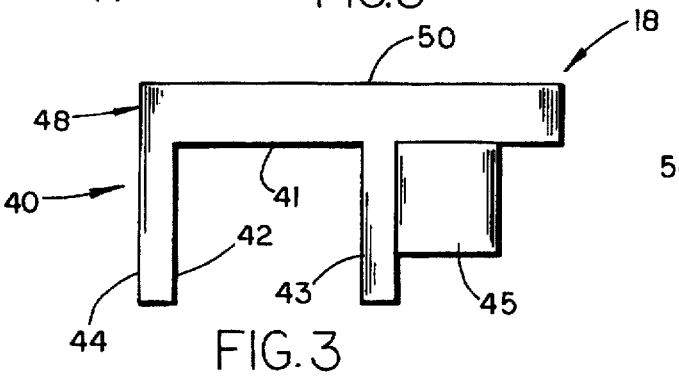

Courtesy panel lower bracket 18 (FIGS. 3–5) is a molded polymeric part that includes a downwardly facing U-shaped first section 40 for slidably engaging an upper edge of the courtesy panel 15. The U-shaped bracket 40 includes a main wall 41 and sidewalls 42 and 43, with each of the sidewalls 42 and 43 including stiffening ribs 44 along their edges. A hollow boss 45 extends from main wall 41 and includes an aperture 46 having threads 47 therein. A second U-shaped section or guide 48 is formed on courtesy panel bracket 18. Section 48 faces upwardly and is oriented 90° from first U-shaped section 41. The second U-shaped section 48 is formed in part by the main wall 41, and further is formed by sidewalls 49 and 50 that extend upwardly. The second U-shaped section 48 defines a guide for receiving a horizontally extending tongue 55 on upper bracket 17, as described below.

Figure 7:
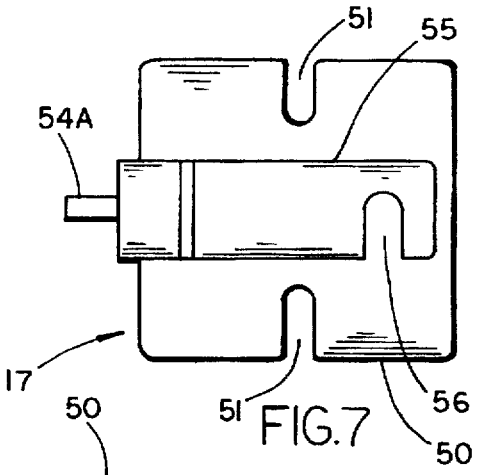
FIGS. 6–8 are orthogonal views of the worksurface engaging bracket.
Figure 6:
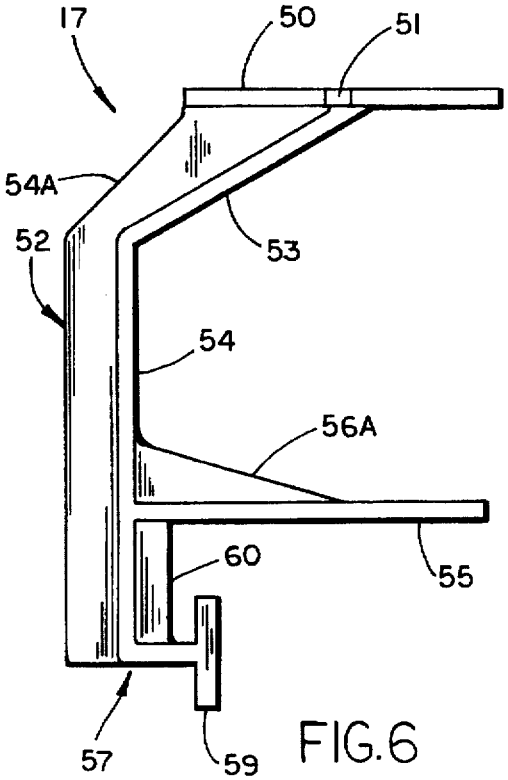
Figure 8:
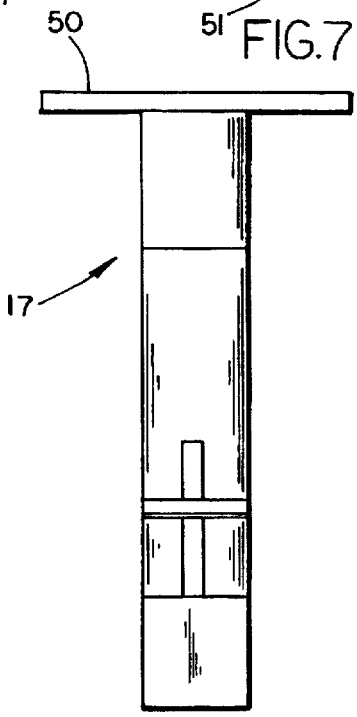

Worksurface-engaging upper bracket 17 (FIGS. 6–8) is a molded polymeric part that includes a planar mounting flange 50 having opposing notches 51 therein for receiving fasteners 51' such as screws to attach worksurface engaging bracket 17 to the undersurface 21 of worksurface 11. Upper bracket 17 further includes a configured leg 52 that extends downwardly at an angle from mounting flange 50. Leg 52 includes an off-set angled section 53, and a vertical section 54, and further includes a reinforcement rib 54A for rigidifying off-set angled leg 52. A lateral extending tongue 55 extends from off-set leg 52. The tongue 55 includes a notch 56 proximate its free end, and further includes a reinforcement rib 56A for rigidifying the laterally extending tongue 55.

A stop 57 extends from the bottom of off-set leg 52 in a direction parallel tongue 55. Stop 57 includes a stop flange or stand-off 59, and a reinforcement rib 60 for rigidifying the stop 57.

Figure 11:
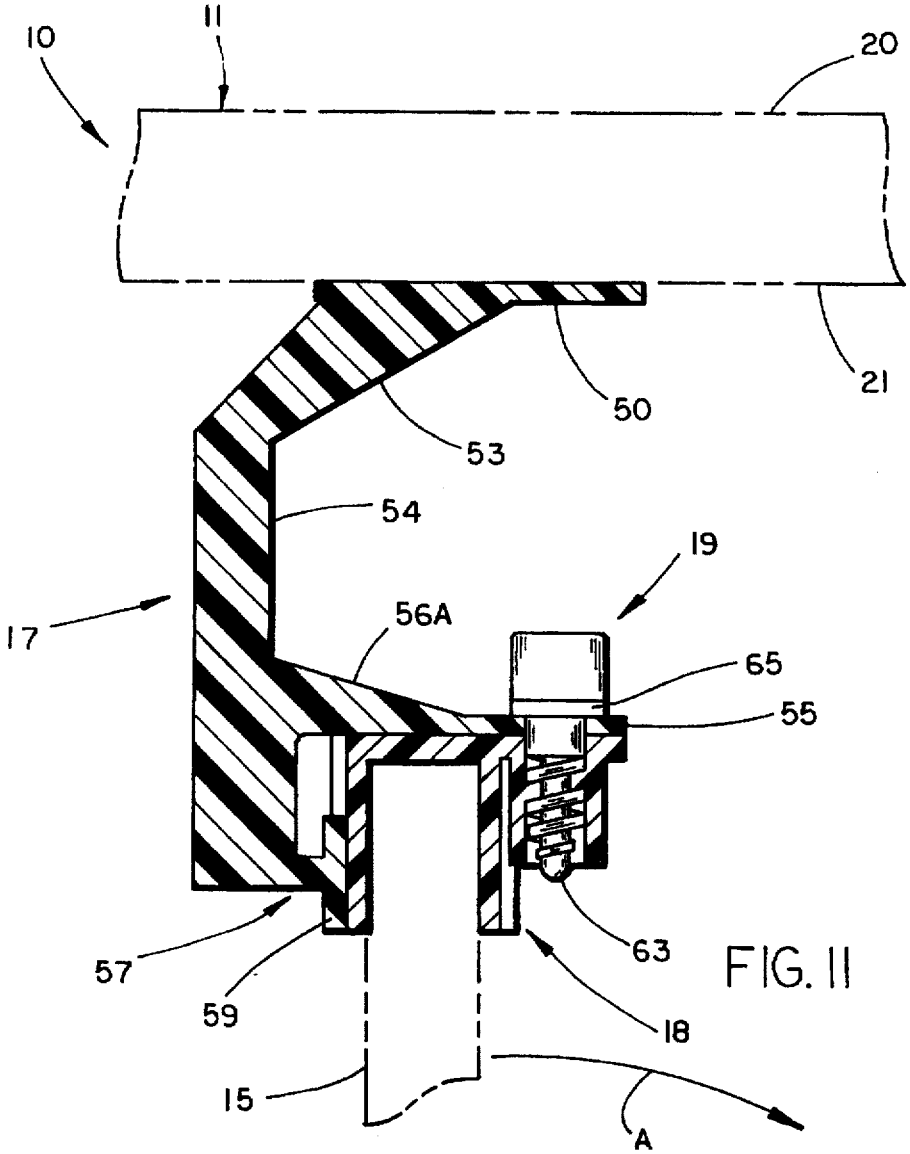
FIG. 11 is a cross-sectional assembly view of the connecting structure.
Figure 9:
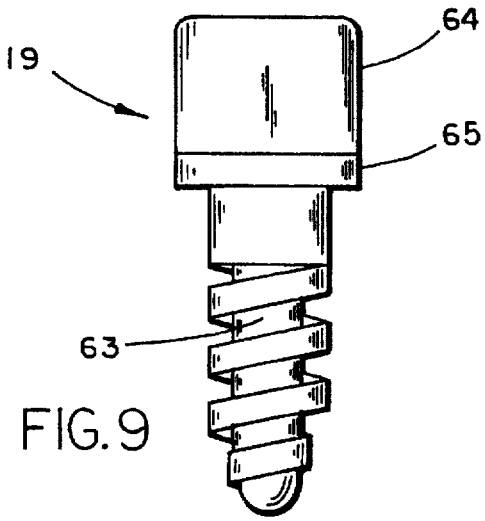
FIGS. 9–10 are side and end views of the fastener.
Figure 10:
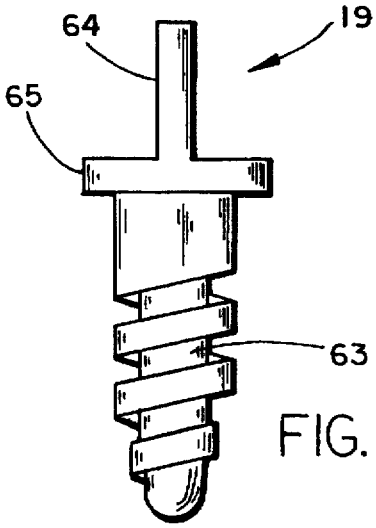

Screw or fastener 19 (FIGS. 9–10) is a molded component including a threaded shaft 63 configured to mateably engage threads 47 of boss 45 on bracket 18. Screw 19 further includes an enlarged head 64 that can be easily turned by hand. A washer 65 is formed on head 64 so that when screw 19 is extended through notch 56 of upper bracket 17 and into boss 45 on lower bracket 18 (FIG. 11), the washer 65 clamps tongue 55 against U-shaped section 48 of bracket 18 to create a secure connection.

In operation, worksurface-engaging bracket 17 is attached to the undersurface of worksurface 11 an accurate distance from rear edge 22 and at a generally centered location therealong. The bracket 17 can be oriented forwardly or rearwardly, but as illustrated in FIG. 1, it is oriented rearwardly. The courtesy-panel-engaging bracket 18 is slipped onto the upper edge of courtesy panel 15, and then slide to desired position therealong that generally aligns with lower bracket 17. As courtesy panel 15 is moved to a closed position, the tongue 55 engages the recess in U-shaped section 48 of lower bracket 18. Once fully seated therein, fastener 19 is inserted through notch 56 into boss 45. Advantageously, fastener 19 includes course threads for quick attachment. Notably, the fastener 19 can include course threads, or can include other fastening means such as a 90° twist lock, push-through friction fit, or the like.

Thus, a connection structure is provided that includes a worksurface-engaging upper bracket, a slidably alignable courtesy-engaging lower bracket, and a fastener for interconnecting same to secure the courtesy panel in a closed position. In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A furniture article comprising:

a worksurface;

worksurface supports, the worksurface supports and the worksurface defining a knee space under the worksurface and an access opening to the knee space located generally under an edge of the worksurface;

a courtesy panel removably mounted to the worksurface supports for movement between a closed position for covering the access opening to the knee space and an open position to facilitate access to the knee space through the access opening; and a connection arrangement including a bracket having a U-shaped portion configured to mateably slidably engage an upper edge of the courtesy panel so that the bracket is horizontally adjustable side-to-side in the knee space to a desired attachment location, and a fastener for releasably engaging an apertured flange on the bracket to retain the courtesy panel in the closed position.

2. The furniture article defined in claim 1 including a second bracket configured for attachment to an underside of the worksurface for mateably engaging the first mentioned bracket.

3. The furniture article defined in claim 2 wherein the first mentioned bracket and the second bracket include mating apertures that align for receiving the fastener when the courtesy panel is in the closed position.

4. The furniture article defined in claim 3 wherein the fastener comprises a polymeric molded part.

5. The furniture article defined in claim 3 wherein the fastener is a screw.

6. The furniture article defined in claim 3 wherein the second bracket includes a tongue for mateably engaging a guide on the first mentioned bracket when the courtesy panel is in the closed position.

7. The furniture article defined in claim 1 including a second bracket for attachment under the worksurface, one of the first mentioned bracket and the second bracket including a tongue and the other of the first bracket and the second mentioned bracket including a guide for mateably receiving the tongue.

8. The furniture article defined in claim 7 wherein the fastener comprising a threaded screw.

9. The furniture article defined in claim 1 wherein the courtesy panel comprises a wood material.

10. A furniture article comprising:

a desk including a worksurface having a bottom surface and an edge, the desk defining a knee space under the worksurface and an access opening to the knee space located generally under the edge;

a first bracket adapted for attachment to a courtesy panel;

a second bracket configured for attachment to the bottom surface of the worksurface, the second bracket defining a tongue;

a courtesy panel movably mounted to the desk for movement between a closed position for covering the access opening to the knee space and an open position to facilitate access to the knee space through the access opening;

the first bracket including a first U-shaped portion for slidably engaging an upper edge of the courtesy panel, the first bracket further including a second U-shaped portion defining a guide for receiving the tongue of the second bracket and further including an aperture; and a fastener configured to engage the aperture and secure the tongue to the second U-shaped portion to retain the courtesy panel in the closed position.

11. The furniture article defined in claim 10 wherein the first and second brackets comprise molded polymeric material.

12. The furniture article defined in claim 10 wherein the fastener comprises polymeric material.

13. The furniture article defined in claim 10 wherein the courtesy panel comprises a wood material.

14. A method comprising steps of:

providing a furniture article including a worksurface and worksurface supports defining a knee space;

providing a courtesy panel pivoted to the furniture article for movement between a closed position closing the knee space and an open position permitting access to the knee space;

providing a first bracket having a U-shaped portion;

slidably engaging the U-shaped portion of the first bracket with an upper edge of the courtesy panel and then adjusting the first bracket transversely in the knee space; and securing the courtesy panel to the underside of the worksurface by engaging the first bracket with a fastener.

15. The method in claim 14 including steps of:

providing a second bracket attached to an underside of the worksurface; aligning the first bracket with the second bracket; and connecting the first and second brackets with the fastener.

* * * * *